US006272994B1

(12) United States Patent
Reider

(10) Patent No.: US 6,272,994 B1
(45) **Date of Patent: *Aug. 14, 2001**

(54) PLASTIC LINER FOR BAYONET PRIMERS

(75) Inventor: John L. Reider, Edina, MN (US)

(73) Assignee: Alliant Techsystems Inc., Hopkins, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/386,810

(22) Filed: Aug. 31, 1999

(51) Int. Cl.[7] ..... F42C 19/10; F42C 19/08; F42B 5/26

(52) U.S. Cl. ..... 102/204; 102/202; 102/470; 102/469

(58) Field of Search ..... 102/202, 204, 102/430–434, 439, 469, 470

(56) References Cited

U.S. PATENT DOCUMENTS

| | | | |
|---|---|---|---|
| 1,491,676 | 4/1924 | Courouble . | |
| 3,182,595 | 5/1965 | Hassman . | |
| 5,052,302 | 10/1991 | Taddeo . | |
| 5,465,665 | 11/1995 | Diehl | 102/470 |
| 5,831,204 | 11/1998 | Lubben . | |
| 5,895,881 * | 4/1999 | Thiesen et al. | 102/202 |

OTHER PUBLICATIONS

Bourgeois and Blackett, High–Density Polyethylenes(H-DPE),1988, Vol. Engineered Materials Handbook, ASM International, pp. 163–166.

* cited by examiner

*Primary Examiner*—Charles T. Jordan
*Assistant Examiner*—Kimberly Smith
(74) *Attorney, Agent, or Firm*—George A. Leone, Sr.

(57) ABSTRACT

A flashtube liner for a primer assembly including a head loading assembly. A flashtube containing an ignition charge has an open rearward end connected to the head loading assembly. A closing plug assembly includes a conically bored open frontward end and an open cylindrical rearward end that may include an optional outer flange between the frontward and rearward ends. The closing plug assembly is attached to the head loading assembly located rearwardly of the flashtube. A flashtube liner has a flange at an open rearward end. The flashtube liner is inserted into the flashtube to line the inner wall of the flashtube. The flashtube liner is held in place by the flashtube impinging the flashtube liner flange between the head loading assembly or the optional flange, and the open rearward end of the flashtube. The flashtube liner is constructed of an extruded plastic material.

19 Claims, 5 Drawing Sheets

PLASTIC LINER FOR BAYONET PRIMERS

CROSS REFERENCE TO RELATED APPLICATION

The present patent application is related to co-pending U.S. patent application Ser. No. 09/386,704, to Reider, entitled "BAYONET PRIMER," filed on Aug. 31, 1999, the same date as the present patent application. The aforesaid to co-pending U.S. patent application Ser. No. 09/386,704 is hereby incorporated by reference.

FIELD OF THE INVENTION

The present invention relates generally to bayonet primer devices, and more particularly to a plastic liner for bayonet primers used in tank ammunition.

BACKGROUND OF THE INVENTION

Bayonet primers have long been used in tank ammunition. Conventional bayonet primers have a cartridge case base that is ejected into the confines of the fighting vehicle after the propelling charge has been ignited by the primer. Unfortunately, in the case of originally designed bayonet type primers, the ejected case base, including the steel primer body created a hot metal tube that was able to come into contact with an ammunition round that was being held ready for loading after the chambered round was extracted. The ejected round could land on the next round and start a fire within the close confines of the fighting vehicle.

To promote safety for the crew of the fighting vehicle and solve the aforesaid fire hazard, tank ammunition primers were sealed with silicone rubber and other materials in order to keep them from igniting when contacting a hot ejected round. Unfortunately, such exterior rubber seals are expensive and have other significant drawbacks.

One current method of sealing bayonet primers uses a paper liner placed inside the flashtube. The flashtube is then dipped in a vat of lacquer, thereby filling flashholes with lacquer to protect the pyrotechnic charge from moisture. Excess lacquer must be scraped from the exterior of the flashtube. Finally, the lacquer plugs so formed are air dried. This is necessary because the various ignition charges are very hygroscopic and the presence of moisture will have an adverse effect upon the ignition charges, causing their degradation and possibly resulting in misfires.

As noted in U.S. Pat. No. 5,465,665 to Diehl issued Nov. 14, 1995, entitled "Primer," a typical bayonet type primer includes a primer head for housing an initial firing stage of a round. An ignition element, pressed into place in the confines of the primer head, is charged with a pyrotechnic composition that starts the firing train. When activated, the ignition element disperses a flame through a retainer. The flame sets off an explosive charge of black powder. The black powder charge in turn propagates through a closing plug, which acts as a directional device to a third charge of Benite. Benite is comprised mainly of nitrocellulose and black powder in a stranded form and other pyrotechnic formulations, housed in the primer body. The third charge propagates through holes in the metal primer body initially sealed with a lacquer. This charge, propagating through the primer body, ignites the propelling charge contained in the ammunition case moving the ammunition projectile such as a penetrator out of the gun barrel and to its target. U.S. Pat. No. 5,465,665 is incorporated in its entirety herein by reference. Unfortunately, Diehl proposes using a hollow tubular one-piece body comprised of a molded thermoplastic material that body still requires lacquer sealing. Alternatively, the perforations in the body may be molded such that there is a thin skin covering the perforations, but this latter method still requires sealing many individual flash holes.

There are several drawbacks to primers constructed in accordance with such known methods. One such drawback is inherent in the use of the sealing lacquer because the lacquer consistency varies within batches and between batches with respect to viscosity and percent solids. Such inconsistencies make the process variable and difficult to control.

Other drawbacks of conventional sealing by paper liner are caused by the method of applying the lacquer that can create bubbles in the flash holes. The presence of bubbles results in a marginal seal. The lacquer itself has undesirable moisture permeability. Further still, it is difficult to determine by inspection whether all flashholes are sealed.

Furthermore, a paper liner, if used, does not always seat tightly to the interior of the flashtube and lacquer may leak into the interior of the primer. As a further drawback, a paper liner is susceptible to being caught by charge strands of Benite during loading. Once so damaged, it is difficult to load the primer charge.

In other types of tank ammunition primers, much shorter primers were used. For example, a stub plastic liner was used with short primers of about one inch in length. Such stub liners were made by injection molding. Injection molded parts are not practical for liners suitable for use with longer bayonet primers. It has been found that injection molding is not desirable for longer liners because 1) the draft angle required to extract the part from the mold reduced the internal volume to the point that sufficient charge could not be loaded, and 2) the injection pressures required to fill the mold quickly pushed the mandrel core against the sidewall, thereby ruining the part.

SUMMARY OF THE INVENTION

The present invention provides a primer assembly with a plastic flashtube liner. A flashtube containing an ignition charge has an open rearward end connected to a head loading assembly. A closing plug assembly includes a conically bored open frontward end and an open cylindrical rearward end that may is include an optional outer flange between the frontward and rearward ends. The closing plug assembly is attached to the head loading assembly located rearwardly of the flashtube. The flashtube liner has a flange at an open rearward end. The flashtube liner is inserted into the flashtube to line the inner wall of the flashtube. In one example, the flashtube liner is held in place by the flashtube impinging the flashtube liner flange between the head loading assembly and the open rearward end of the flashtube. The flashtube liner is comprised of an extruded plastic material.

In contrast to the prior art, the present invention provides a plastic flashtube liner that has the advantage of eliminating the use of a liquid to seal the flashholes.

As a further advantage, the liner of the present invention reduces the number of seals from one for each flashhole to a single piece seal.

As a further advantage, the plastic liner of the invention significantly increases the safety of workers during assembly by allowing the charge to be loaded into inert sleeves prior to entering the assembly area, greatly reducing the exposed surface of explosive material during primer assembly.

As a further advantage, the plastic liner of the invention eliminates all need to maintain complicated purple lacquer processes requiring monitoring of temperature, percent volatiles/solids and mixing, and eliminates the multi-step process to insert a paper liner, including dipping, drying, inspecting, and reworking lacquer seals.

As a further advantage, the plastic liner of the invention improves safety of the operators by eliminating exposure to potentially harmful fumes.

As a further advantage, the plastic liner of the invention improves inspectability because the flashtube liner can be pressure tested for integrity before is assembly onto the primer. For example, the plastic tube can be leak tested prior to assembly and is made from a stable, virtually inert, plastic material that is impervious to moisture.

As a further advantage, the plastic liner of the invention is far more inert and stable than the lacquer previously used in this process.

Other objects, features and advantages of the invention will become apparent to those skilled in the art through the description of the preferred embodiment, claims and drawings herein wherein like numerals refer to like elements.

DETAILED DESCRIPTION OF THE INVENTION

Figure 1:
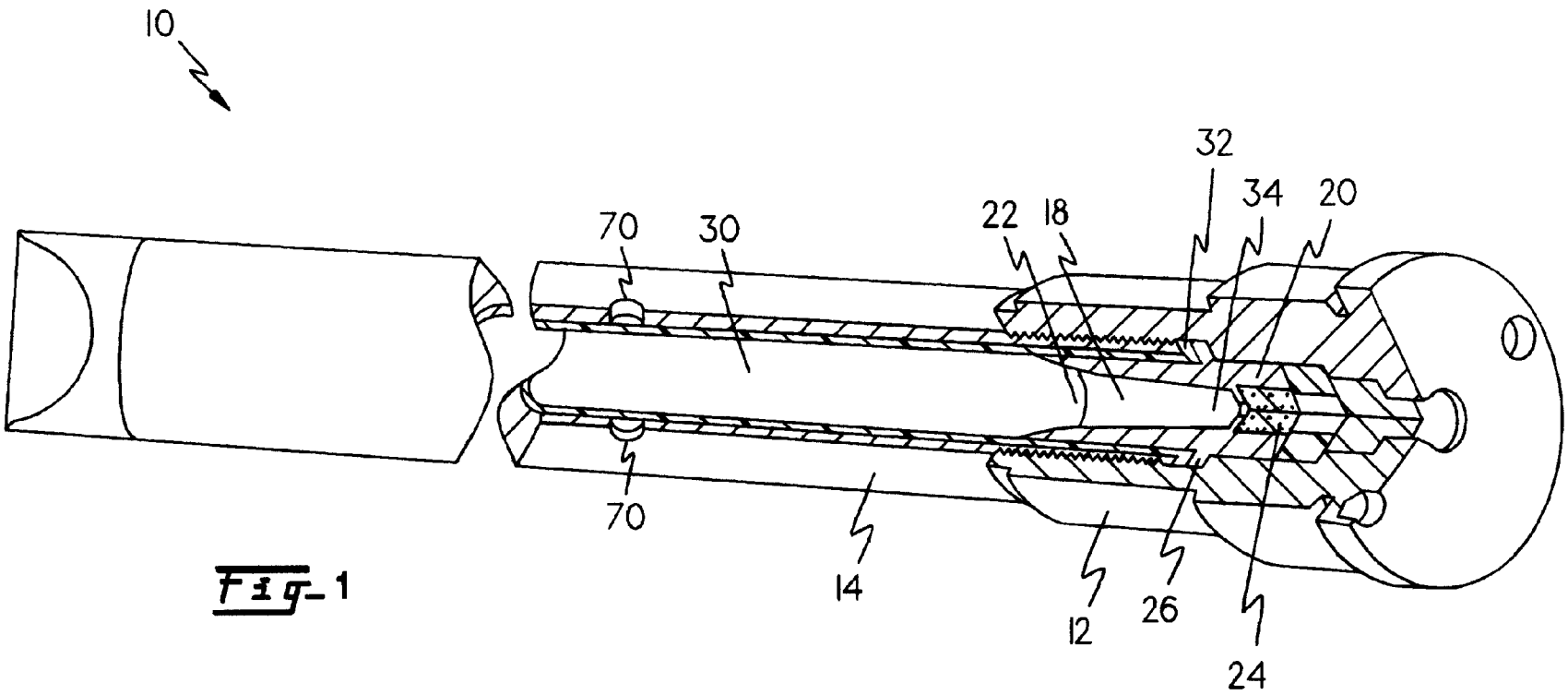
FIG. 1 is a partial cut-away perspective view of one example of a bayonet primer including a plastic liner as contemplated by the present invention.

FIG. 1 is a partial cut-away perspective view of one example of a bayonet primer including a plastic liner as contemplated by the present invention. The primer assembly 10 includes a head loading assembly 12, and a flashtube 14. An open rearward end 18 of the flashtube 14 is connected to the head loading assembly 12 located rearwardly of the flashtube. A closing plug assembly 20 includes a conically bored open frontward end 22 and an open cylindrical rearward end 24 including an optional outer flange 26 between the frontward and rearward ends. The closing plug assembly 20 is attached to the head loading assembly 12. The flashtube includes a plurality of holes 70 disposed along the length of the flashtube. An extruded plastic flashtube liner 30 is affixed within the flashtube to seal the holes.

The flashtube liner 30 has a flange 32 at an open rearward end 34. The flashtube liner 30 is inserted into the flashtube 14 so as to line the inner wall of the flashtube 14. In one embodiment of the invention, the flashtube liner 30 is held in place by the flashtube 14 impinging the flashtube liner flange 32 between the closing plug assembly outer flange 26 and the open rearward end 18 of the flashtube. To complete the primer assembly 10, the flashtube liner is loaded with a charge of Benite 60, substantially comprising black powder in a stranded medium (best shown in FIG. 4). The rearward end 18 of the flashtube is threaded into the head loading assembly 12 to a depth defined by the flashtube liner disposed between the closing plug assembly outer flange 26 and the open rearward end 18 of the flashtube.

Figure 2:
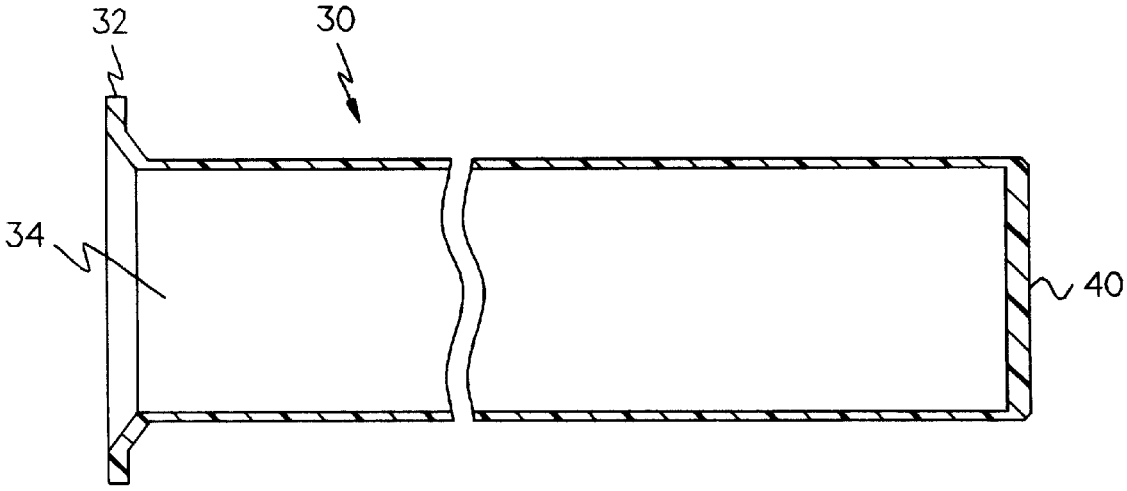
FIG. 2 is a cross-sectional view of one example of a plastic liner tube assembly as contemplated by the present invention.

Referring now to FIG. 2, a cross-sectional view of one example of a plastic liner tube assembly as contemplated by the present invention is shown. The flashtube liner 30 is an extruded plastic tube having a flange 32 and an open rearward end 34 and a top end 40.

In one example, the flashtube liner is comprised substantially of an extruded plastic material. In a more preferred embodiment of the invention, the extruded plastic material comprises an extruded high density polyethylene material. It has been found that the high density polyethylene material works well for constructing a flashtube liner having a length greater than 2 inches. The plastic liner may also be made using rotary or blow-molded processes.

In some prototype devices, the material chosen for the plastic in these parts was polyethylene. This material had been prior approved for use in contact with explosives, and was also used to make milk/water jugs, tanks and containers for storing alcohol and acetone for extended periods of time to prevent moisture contamination of the contents. Nearly any plastic that has melt characteristics acceptable to the end use storage requirements could be used.

Figure 3:
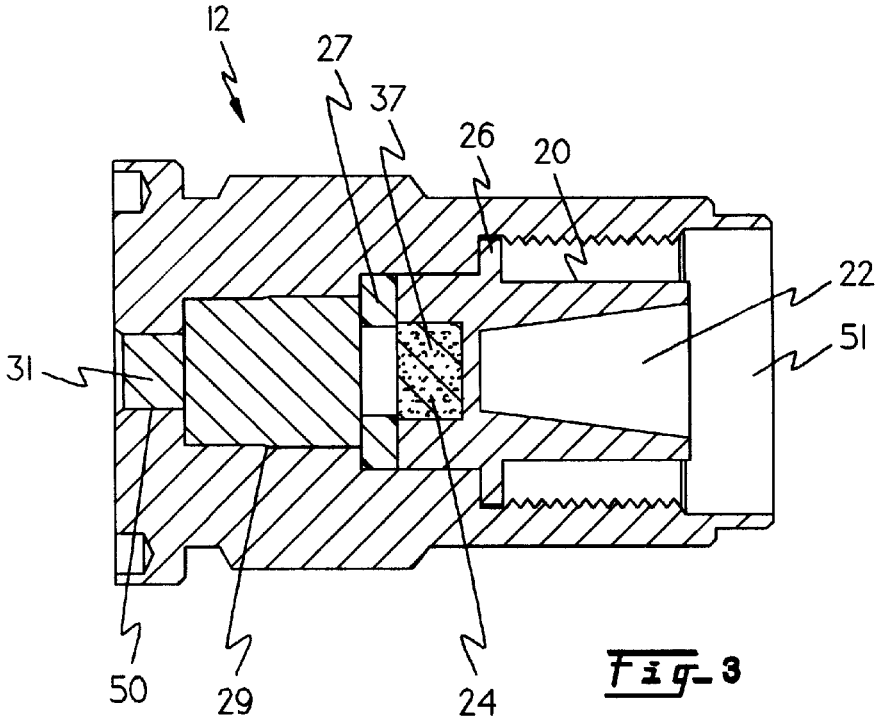
FIG. 3 is a cross-sectional view of one example of a head loading assembly as contemplated by the present invention.

FIG. 3 is a cross-sectional view of one example of a head loading assembly 12 including a closing plug assembly 20 and an ignition element 29 as contemplated by the present invention. The head loading assembly 12 includes a frontward throughbore 51. The closing plug assembly is attached within the frontward throughbore 51. The closing plug assembly 20 includes a conically bored open frontward end 22 and an open cylindrical rearward end 24 including an optional outer flange 26 between the frontward and rearward ends. The closing plug assembly rearward end 24 contains black powder 37. The head loading assembly 12 includes a rearward throughbore 50. An ignition element 29 is attached within the rearward throughbore 50. When activated, the ignition element 29 is positioned to be in communication with the black powder contained in the closing plug assembly. The ignition element 29 includes a conventional electrode 31. In some embodiments, a retainer 27 may be juxtaposed between the closing plug assembly and the ignition element. The closing plug assembly 20 is attached to the head loading assembly 12 by press fitting the closing plug assembly into the frontward throughbore 51.

Figure 4:
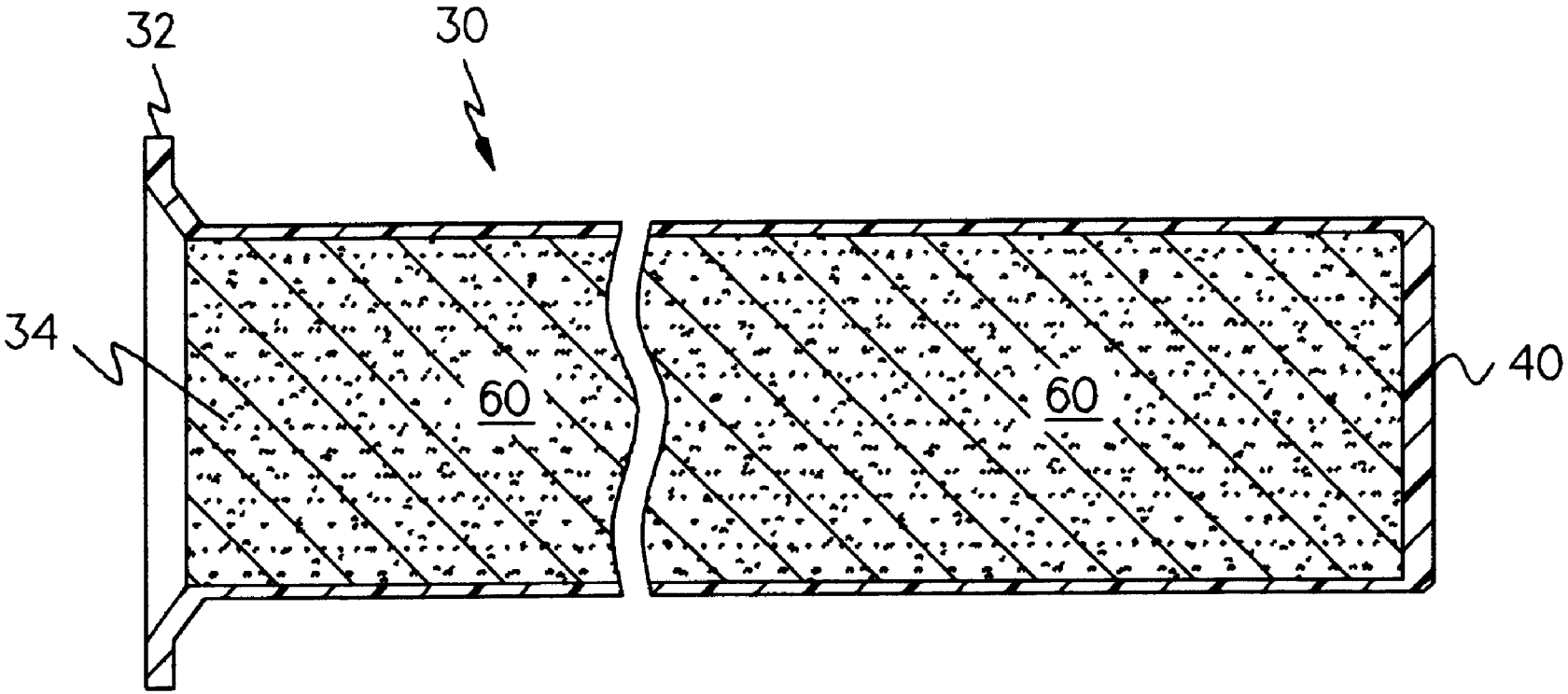
FIG. 4 is a cross-sectional view of one example of a plastic liner tube assembly loaded with Benite as contemplated by the present invention.

Referring now to FIG. 4, a cross-sectional view of one example of a plastic liner tube assembly loaded with Benite 60 as contemplated by the present invention is shown. The Benite 60 may be loaded before inserting the liner into the flashtube.

Figure 5:
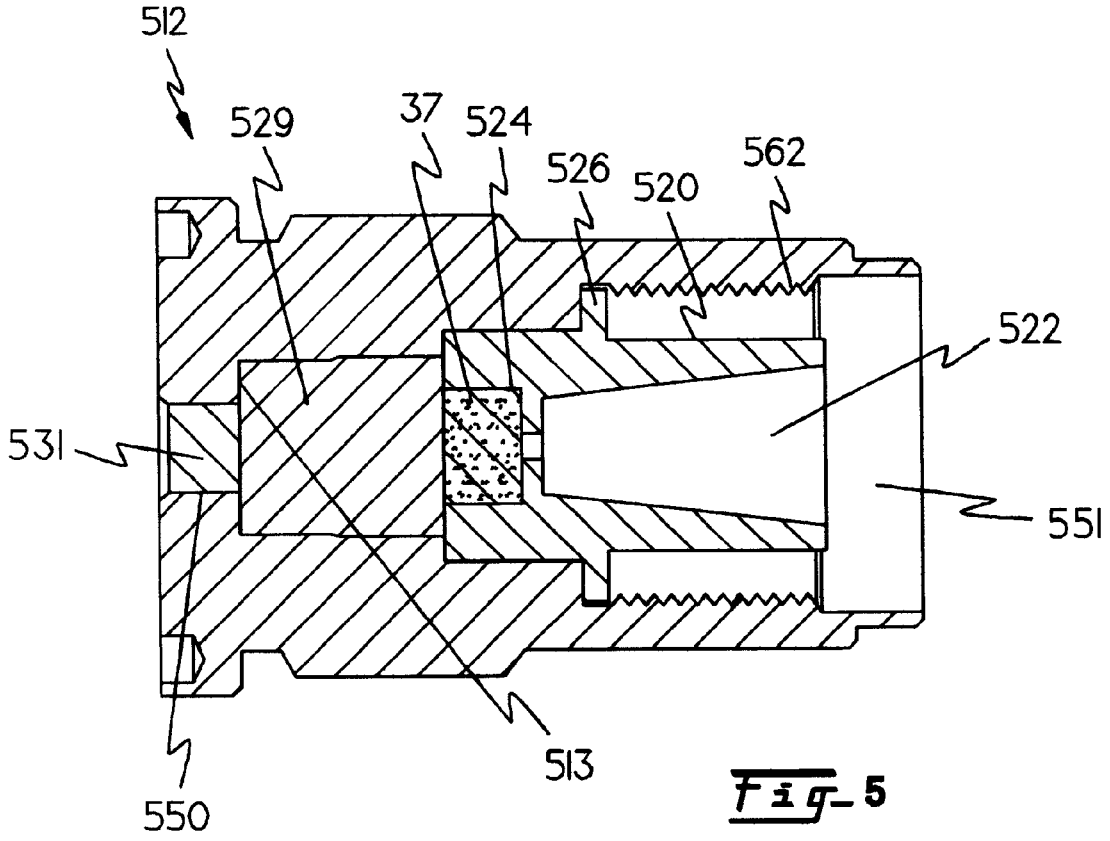
FIG. 5 is a cross-sectional view of one example of an interlocking and press fit head loading assembly including a lengthened closing plug assembly as contemplated by the present invention.

FIG. 5 is a cross-sectional view of an example embodiment of an interlocking and press fit head loading assembly 512 including a lengthened closing plug assembly 520 and an ignition element 529 as contemplated by the present invention. Note that, in contrast to the configuration of FIG. 3, the lengthened closing plug assembly 520 eliminates the need for spacers. The head loading assembly 512 includes a frontward throughbore 551. The closing plug assembly is press fitted within the frontward throughbore 551. The closing plug assembly 520 includes a conically bored open frontward end 522 and an open cylindrical rearward end 524 including an outer flange 526 between the frontward and rearward ends. The closing plug assembly rearward end 524 contains black powder 37. The black powder 37 may conventionally be held in place by adhesive tape (not shown). The head loading assembly 512 includes a rearward throughbore 550.

The ignition element 529 is attached within the rearward throughbore 550 pressed against the closing plug assembly rearward end enclosing black powder 37. The ignition element 529 includes a conventional electrode 531. The closing plug assembly 520 is sized to be press fit into the frontward throughbore 551. The ignition element assembly 529 is configured to be press fit into the rearward throughbore 550, bearing against stop 513. The head loading assembly 512 also includes threads 562 for threadedly attaching the flashtube 14.

As best shown in FIG. 1, once the flashtube 14 is attached to the threaded portion of the head loading assembly, the interior parts, including the flashtube liner 30, head loading assembly 12 with the closing plug assembly 20, and the ignition element assembly 31, are held in place. Specifically, the flashtube 14 is threaded onto the head loading assembly 12. The closing plug assembly includes an outer flange 26. The flashtube liner 30 is captivated between the outer flange 26 and the flashtube 14.

Figure 6:
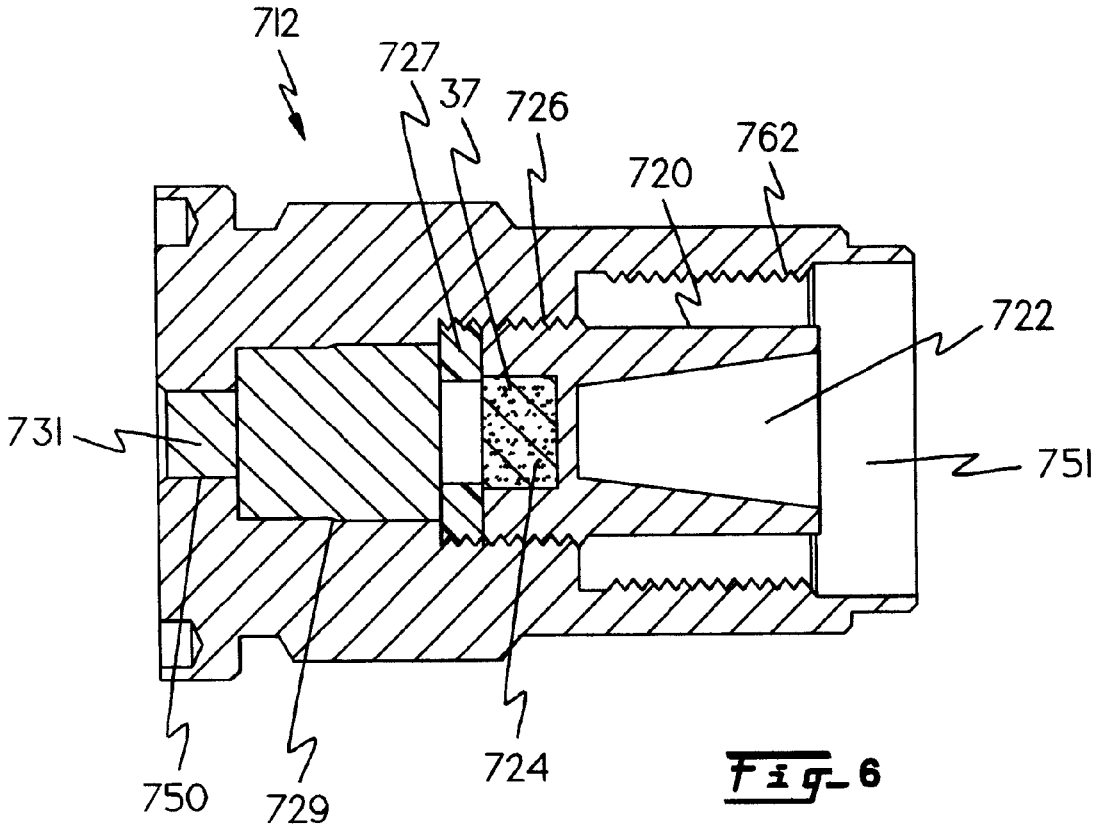
FIG. 6 is a cross-sectional view of a conventional threaded head loading assembly as contemplated for use in an alternate embodiment of the present invention.

FIG. 6 is a cross-sectional view of of a conventional threaded head loading assembly 712 including a closing plug assembly 720 and an ignition element 729. Similarly, to the head loading assembly of FIG. 3, the head loading assembly 712 includes a frontward throughbore 751. The closing plug assembly is threaded within the frontward throughbore 751. The closing plug assembly 720 includes a conically bored open frontward end 722 and an open cylindrical rearward end 724 including an outer threaded surface 726. The closing plug assembly rearward end 724 contains black powder 37. The black powder 37 may conventionally be held in place by adhesive tape (not shown). The head loading assembly 712 includes a rearward throughbore 750. In some embodiments, a retainer 727 may be juxtaposed between the closing plug assembly and the ignition element.

The ignition element 729 is attached within the rearward throughbore 750 secured by retainer 727. The ignition element 729 includes a conventional electrode 731. The closing plug assembly 720 is threaded into the frontward throughbore 751. The ignition element assembly 729 may be configured to be press fit into the rearward throughbore 750. The head loading assembly 712 also includes threads 762 for threadably attaching the flashtube 14(shown in FIG. 1).

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different materials and structural configurations, and that various modifications, both as to materials and structural configurations and operating procedures, may be accomplished without departing from the true spirit and scope of the present invention.

The embodiments of an invention in which an exclusive property or right is claimed are defined as follows:

1. A primer assembly comprising:

a) a head loading assembly;

b) a flashtube containing an ignition charge, an open rearward end of said flashtube connected to said head loading assembly;

c) a closing plug assembly including an open frontward end and an open rearward end, said closing plug assembly being attached to said head loading assembly located rearwardly of said flashtube; and d) a flashtube liner having a flange at an open rearward end, said flashtube liner inserted into said flashtube so as to line the inner wall of said flashtube, wherein said flashtube liner is comprised of an extruded plastic material.

2. The primer assembly of claim 1 wherein said extruded plastic material comprises an extruded high density polyethylene material.

3. The primer assembly of claim 1 wherein said flashtube liner has a length greater than 2 inches.

4. The primer assembly of claim 1 wherein said flashtube liner is loaded with a charge including black powder in a stranded medium.

5. The primer assembly of claim 1 wherein said rearward end of said flashtube is threaded into said head loading assembly to a depth defined by said flashtube liner flange and said open rearward end of said flashtube threaded into said head loading assembly.

6. The primer assembly of claim 1 wherein said closing plug assembly rearward end contains black powder.

7. The primer assembly of claim 6 further comprising a) said head loading assembly including a rearward throughbore; and b) an ignition element attached within said rearward throughbore in communication with said black powder contained in said closing plug assembly.

8. An improved primer assembly including a flashtube attached to a head loading assembly including a closing plug assembly with a closing plug assembly flange, wherein said flashtube includes a plurality of holes disposed along the length of said flashtube, the improvement comprising an extruded plastic flashtube liner affixed within said flashtube so as to seal said plurality of holes, wherein said rearward end of said flashtube is threaded into said head loading assembly to a depth defined by said flashtube liner disposed between said closing plug assembly flange and said open rearward end of said flashtube.

9. The improved primer assembly of claim 8 wherein said extruded plastic flashtube liner comprises a high density polyethylene material.

10. The improved primer assembly of claim 8 wherein said extruded plastic flashtube liner is loaded with charge including black powder in a stranded medium.

11. The improved primer assembly of claim 10 wherein said extruded plastic flashtube liner comprises a high density polyethylene material.

12. The primer assembly of claim 1 wherein said flashtube has a series of perforations in its wall.

13. The primer assembly of claim 12 wherein said perforations are covered by said flashtube liner.

14. A primer assembly comprising:

a) a head loading assembly;

b) a flashtube having an open rearward end connected to said head loading assembly;

c) a closing plug assembly including a conically bored open frontward end and an open cylindrical rearward end including an outer flange between said frontward and rearward ends, said closing plug assembly attached to said head loading assembly located rearwardly of said flashtube;

d) a flashtube liner containing a charge, and having a flange at an open rearward end, said flashtube liner inserted into said flashtube so as to line the inner wall of said flashtube, wherein said flashtube liner is held in place by said flashtube impinging said flashtube liner flange between said closing plug assembly flange and said open rearward end of said flashtube; and e) wherein said flashtube liner is comprised of a high density polyethylene material.

15. The primer assembly of claim 14 wherein said flashtube liner has a length greater than 2 inches.

16. The primer assembly of claim 14 wherein said flashtube has a series of perforations in its wall.

17. The primer assembly of claim 14 wherein said flashtube liner comprises an extruded material.

18. The primer assembly of claim 14 wherein said flashtube liner is constructed using a rotary molding process.

19. The primer assembly of claim 14 wherein said flashtube liner is constructed using a blow molding process.

* * * * *